US006334948B1

(12) United States Patent
Didillon et al.

(10) Patent No.: US 6,334,948 B1
(45) Date of Patent: Jan. 1, 2002

(54) PROCESS FOR PRODUCING GASOLINE WITH A LOW SULPHUR CONTENT

(75) Inventors: Blaise Didillon, Rueil Malmaison; Denis Uzio, Marly le Roi; Jean-Luc Nocca, Rueil Malmaison; Jean Cosyns, Maule, all of (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 0 days.

(21) Appl. No.: 09/443,152

(22) Filed: Nov. 18, 1999

(30) Foreign Application Priority Data

Nov. 18, 1998 (FR) ..... 98 14480

(51) Int. Cl.[7] ..... C10G 45/06; C10G 45/08
(52) U.S. Cl. ..... 208/218; 208/216 R; 208/217
(58) Field of Search ..... 208/82, 216 R, 208/217, 218, 243, 244

(56) References Cited

U.S. PATENT DOCUMENTS

| | | | | |
|---|---|---|---|---|
| 4,131,537 A | | 12/1978 | Winter et al. | 208/216 |
| 4,397,739 A | * | 8/1983 | Jacquin et al. | 208/210 |
| 4,990,242 A | * | 2/1991 | Louie et al. | 208/218 |
| 6,120,679 A | * | 9/2000 | Katanaka et al. | 208/217 |
| 6,251,263 B1 | * | 6/2001 | Hatanaka et al. | 208/210 |

FOREIGN PATENT DOCUMENTS

| | | |
|---|---|---|
| BE | 647626 | 8/1964 |
| DE | 1 030 952 | 5/1958 |
| EP | 0 725 126 | 8/1996 |
| EP | 0 781 830 | 7/1997 |
| WO | 94/22980 | 10/1994 |
| WO | 96/18704 | 6/1996 |

* cited by examiner

*Primary Examiner*—Bekir L. Yildirim
(74) *Attorney, Agent, or Firm*—Millen, White, Zelano & Branigan, P.C.

(57) ABSTRACT

A process for producing a gasoline with a low sulphur content comprises: separating a sulphur-containing gasoline into a light fraction and a heavy fraction, hydrodesulphurising the light gasoline on a nickel-based catalyst, hydrodesulphurising the heavy fraction on a catalyst comprising at least one group VIII metal and/or at least one group VIB metal, and mixing the desulphurised fractions.

23 Claims, No Drawings

PROCESS FOR PRODUCING GASOLINE WITH A LOW SULPHUR CONTENT

The present invention relates to a process for producing gasoline with a low sulphur content, which enables the whole of a sulphur-containing gasoline cut to be upgraded, and to reduce the total sulphur and mercaptan content of said gasoline cut to very low levels with no substantial drop in the gasoline yield, while minimising the octane number reduction.

PRIOR ART

The production of reformulated gasolines satisfying the latest environmental specifications primarily requires reducing the concentration of olefins and/or aromatics (especially benzene) and sulphur (including mercaptans). Catalytically cracked gasoline has a high olefin content, and the sulphur present in reformulated gasoline in particular is attributable to an extent of almost 90% to catalytic cracking gasoline (FCC, fluid catalytic cracking, or fluidised bed catalytic cracking). Desulphurising (hydrodesulphurising) gasoline and principally FCC gasoline is thus of clear importance.

Hydrotreating (hydrodesulphurising) the feed sent for catalytic cracking results in gasoline which typically contains 100 ppm of sulphur. Units for hydrotreating catalytically cracked feeds operate, however, under severe temperature and pressure conditions, which thus means a substantial investment. Further, the whole of the feed has to be desulphurised, which means that very large volumes of feed have to be treated.

When carried out under conventional conditions which are known to the skilled person, hydrotreating (or hydrodesulphurising) catalytic cracking gasoline, can reduce the sulphur content of the cut. However, that process has the major disadvantage of causing a very substantial drop in the octane number of the cut because of saturation of all of the olefins during the hydrotreatment.

Separating a light and a heavy gasoline before hydrotreating has already been claimed in United States patent US-A-4 397 739. That patent claims a process for hydrodesulphurising gasoline comprising fractionating the gasoline into a light fraction and a heavy fraction and specific hydrodesulphurisation of the heavy fraction.

Further, US-A-4 131 537 teaches that it is important to fractionate the gasoline into several cuts, preferably three, as a function of their boiling point, and desulphurising them under conditions which can be different. That patent indicates that the major benefit is obtained when the gasoline is fractionated into three cuts and when the cut with intermediate boiling points is treated under mild conditions.

European patent application EP-A-0 725 126 describes a process for hydrodesulphurising a cracking gasoline in which the gasoline is separated into a plurality of fractions comprising at least a first fraction which is rich in compounds which are easy to desulphurise and into a second fraction which is rich in compounds which are difficult to desulphurise. Before carrying out that separation, the distribution of the sulphur-containing products must be determined by analysis. Such analyses are necessary to be able to select the apparatus and the separation conditions.

That application also claims that the olefin content and octane number of a light fraction of cracked gasoline fall substantially when it is desulphurised without being fractionated. In contrast, fractionation of that light fraction into 7 to 20 fractions followed by analyses of the sulphur contents and olefin contents of those fractions enables the fraction or fractions which are richest in sulphur- containing compounds to be determined, which fractions are then desulphurised simultaneously or separately and mixed with other desulphurised or non desulphurised fractions. Such a procedure is complex and must be repeated every time the composition of the gasoline to be treated is changed.

It is also important to note that compounds which are termed "easy" to desulphurise are particularly, as indicated in application EP-A-0 725 126, benzothiophene and methylbenzothiophene which have boiling points of 220° C. and 244° C. respectively. Such compounds are thus in the "high boiling point" cut of US-A-4 131 537, which according to that patent requires the most severe treatment for desulphurisation.

US-A-5 290 427 has proposed processes for hydrotreating gasoline consisting of fractionating the gasoline then desulphurising the fractions and converting the desulphurised fractions on a ZSM-5 zeolite to compensate for the octane number loss by isomerisation.

US-A-5 318 690 proposes a process with fractionation of the gas and sweetening of the light 25 fraction, while the heavy fraction is desulphurised then converted on ZSM-5 and desulphurised again under mild conditions. That technique is based on separating the unrefined gasoline so as to obtain a light cut which is practically free of sulphur-containing compounds other than mercaptans. That enables the cut to be treated solely with a sweetening method which removes the mercaptans.

For this reason, the heavy cut contains a relatively large quantity of olefins which are partially saturated during hydrotreatment. To compensate for the drop in octane number connected with olefin hydrogenation, the patent recommends cracking on ZSM-5 zeolite which produces olefins, but to the detriment of the yield. Further, such olefins can recombine with the $H_2S$ present in the medium to reform the mercaptans. Sweetening or supplemental hydrodesulphurisation must then be carried out.

SUMMARY OF THE INVENTION

The present invention relates to a process for producing gasoline with a low sulphur content, which enables the whole of a sulphur-containing gasoline cut to be upgraded, and to reduce the total sulphur and mercaptan content of said gasoline cut to very low levels, with no substantial drop in the gasoline yield, while minimising the octane number reduction.

The process of the invention is a process for producing a gasoline with a low sulphur content from a sulphur-containing gasoline cut. The process of the invention comprises separating said gasoline into a light fraction and a heavy fraction, hydrodesulphurising the light gasoline on a nickel-based catalyst, hydrodesulphurising the heavy fraction on a catalyst comprising at least one group VIII metal and/or at least one group VIB metal, and mixing the desulphurised fractions.

The feed for the process of the invention is a gasoline cut containing sulphur, preferably a gasoline cut from a catalytic cracking unit, with a boiling point range typically from about the boiling points of hydrocarbons containing 5 carbon atoms (C5) to about 220° C. The end point of the gasoline cut depends on the refinery from which it originates and market constraints, but generally remains within the limits indicated above.

The process of the invention comprises separating the gasoline into two fractions: a light fraction (also termed the light fraction or light gasoline below) with an end point generally of about 160° C. or less, preferably less than 140° C. and more preferably less than 120° C., a heavy fraction (also termed the heavy fraction or heavy gasoline below) constituted by the heavy fraction which is complementary to the light gasoline.

In general, the cut point is selected so as to maximise the olefin content in the light cut. This content can readily be determined, for example by means of a bromine number determination, which is generally available on-site.

Hydrodesulphurisation (also known as hydrotreatment) of the light gasoline is carried out over a nickel-based catalyst (described in a simultaneously filed patent application), and hydrodesulphurisation of the heavy fraction on a conventional hydrotreatment (hydrodesulphurisation) catalyst comprising a group VIII metal and a group VIB metal.

The desulphurised light and heavy cuts are then mixed. The effluent obtained can optionally be stripped to eliminate the $H_2S$ produced during hydrodesulphurisation.

It is also possible, and preferred particularly when the gasoline to be desulphurised contains polyolefins (dienes), to carry out selective hydrogenation of the gasoline before fractionation.

DETAILED DESCRIPTION OF THE INVENTION

It has been observed that, unexpectedly, a combination of this simple fractionation of a gasoline with hydrodesulphurisation of the light fraction on a nickel-based catalyst and hydrodesulphurisation of the heavy fraction over a conventional catalyst can produce, after mixing the desulphurised fractions, a desulphurised gasoline which has no substantial reduction of the olefin content or the octane number.

The sulphur-containing species in the feeds treated by the process of the invention can be mercaptans or heterocyclic compounds such as thiophenes or alkylthiophenes, or heavier compounds such as benzothiophene. In contrast to mercaptans, these heterocyclic compounds, cannot be eliminated by extractive processes. These sulphur-containing compounds are thus eliminated by hydrotreatment which decomposes them into hydrocarbons and $H_2S$.

In the light fraction, sulphur-containing compounds can be found with boiling points of less than 160° C. or even less than 140° C., preferably less than 120° C. Examples of these compounds which can be cited are methanethiol (BP=6° C.), ethanethiol (BP=35° C.), propanethiol (BP=68° C.), thiophene (BP=84° C.), thiacyclobutane (BP=95° C.), pentanethiol (BP=99° C.), 2-methylthiophene (BP=113° C.), 3-methylthiophene (BP=115° C.), thiacyclopentane (BP=121° C.), 2-methylthiacyclopentane (BP=133° C.), 2-ethylthiophene (BP=134° C.), 3-ethylthiophene (BP=136 ° C.), 2,5-dimethylthiophene (BP=137° C.), 3-methylthiacyclopentane (B=139° C.), 2,4-dimethylthiophene (BP=141° C.), 2,3-dimethylthiophene (BP=142° C.), 2,5-dimethylthiacyclopentane (BP=142° C.), 3,3-dimethylthiacyclopentane (BP=145° C.), 3,4-dimethylthiophene (BP=145° C.), 2,3-dimethylthiacyclopentane (BP=148° C.), 2-isopropylthiophene 5 (BP=153° C.), 3-isopropylthiophene (BP=157° C.) and 3-ethyl-2-methylthiophene (BP=157° C.).

The sulphur content of the gasoline cuts produced by catalytic cracking (FCC) depends on the sulphur content of the feed treated by FCC, and on the end point of the cut. Light fractions, of course, have a lower sulphur fraction than heavier fractions.

In general, the sulphur contents of the whole of the gasoline cut, in particular those from FCC, are more than 100 ppm by weight and usually more than 500 ppm by weight. For gasolines with end points of over 200° C., the sulphur contents are usually more than 1000 ppm by weight, and can in some cases reach values of the order of 4000 to 5000 ppm by weight.

The steps of the process of the invention will be described in more detail below.

Diene Hydrogenation

Diene hydrogenation is an optional but advantageous step, which can eliminate almost all of the dienes present in the sulphur-containing gasoline cut to be treated prior to hydrodesulphurisation.

It is generally carried out in the presence of a catalyst comprising at least one group VIII metal:, preferably selected from the group formed by platinum, palladium and nickel, and a support. As an example, a catalyst containing 1% to 20% by weight of nickel deposited on an inert support such as alumina, silica or silica-alumina or a support containing at least 50% of alumina can be used. This catalyst operates at a pressure of 0.4 to 5 MPa, at a temperature of 50° C. to 250° C., with a liquid hourly space velocity of 1 to $10h^{-1}$. Another metal can be associated to form a bimetallic catalyst, such as molybdenum or tungsten.

It may be particularly advantageous, especially when treating cuts with a boiling point of less than 160° C., to operate under conditions such that the gasoline is at least partially sweetened, i.e., a certain reduction in the mercaptan content. To this end, the procedure described in French patent application FR-A-2 753 717, which employs a palladium-based catalyst, can be used.

The choice of operating conditions is particularly important. Most generally, the operation is carried out under pressure in the presence of a quantity of hydrogen which is in slight excess with respect to the stoichiometric value necessary to hydrogenate the diolefins. Hydrogen and the feed to be treated are injected into a reactor as an upflow or downflow, preferably with a fixed catalyst bed. The temperature is most generally in the range from about 50° C. to about 250° C., preferably in the range 80° C. to 200° C., more preferably in the range 160° C. to 190° C.

The pressure is sufficient to maintain more than 80%, preferably more than 95% by weight of the gasoline to be treated in the liquid phase in the reactor; more generally, it is in the range 0.4 to 5 MPa, preferably more than 1 MPa. The pressure is advantageously in the range 1 to 4 MPa. The space velocity is in the range from about 1 to about $10h^{-1}$, preferably in the range 4 to $10h^{-1}$.

The light fraction of the gasoline cut from catalytic cracking can contain up to a few % by weight of diolefins. After hydrogenation, the diolefin content is generally reduced to less than 3000 ppm, or even to less than 2500 ppm and more preferably to less than 1500 ppm. In some cases, it can be less than 500 ppm. The diene content after selective hydrogenation can even, if necessary, be reduced to less than 250 ppm.

In one implementation of the invention, the diene hydrogenation step is carried out in a catalytic hydrogenation reactor which comprises a catalytic reaction zone traversed by the whole of the feed and the quantity of hydrogen necessary to carry out the desired reactions.

Separation of Light and Heavy Gasoline

This step consists of fractionating the gasoline into two fractions, a light fraction, also known as the light gasoline fraction, and a heavy fraction also known as the heavy gasoline. The cut point between these two gasolines corresponds to the final boiling point (also known as the end point) of the light gasoline, and to the initial boiling point (initial point) for the heavy gasoline. It is at a temperature which is generally less than 160° C. as regards the boiling point, preferably less than 140° C., and more preferably less than 120° C.

The end point (cut point between the light and heavy fraction) of the light gas is thus about 160° C. or more, preferably more than 140° C. and more preferably more than 120° C.

The heavy gasoline corresponds to the heavy fraction which is complementary to the light fraction. It has an initial point which is generally 160° C. or more, preferably more than 140° C. and more preferably more than 120° C.

This separation can be carried out using any technique which is known to the skilled person, such as distillation or adsorption.

Hydrodesulphurisation of the Light Fraction

The end point of the light gasoline cut depends, of course, on the refinery, but remains within the limits indicated above. The feed is preferably a light gasoline from separating a catalytic cracking gasoline.

Suitable catalysts are nickel-based catalysts which are preferably supported.

The nickel content of the catalyst used in the invention is generally in the range from about 1% to about 80% by weight, preferably in the range 5% to 70% by weight and more preferably in the range 10% to 50% by weight. Preferably, the catalyst is generally formed, preferably into beads, extrudates, pellets or trilobes. The nickel can be incorporated into the catalyst on the preformed support, but can also be mixed with the support before the forming step. The nickel is generally introduced in the form of a precursor salt, which is generally water-soluble, such as nickel nitrate. This mode of introduction is not specific to the invention. Any other mode known to the skilled person is suitable for the invention.

The catalyst supports used in the process of the invention are generally porous solids selected from refractory oxides such as aluminas, silicas and silica-aluminas, magnesia, also titanium oxide and zinc oxide, these latter oxides being able to be used alone or mixed with alumina or silica-alumina. Preferably, the supports are transition aluminas or silicas with a specific surface area in the range 25 to 350 $m^2/g$. The supports selected from natural compounds (for example kieselguhr or kaolin) are also suitable as supports for the catalysts of the process of the invention.

After introducing the nickel and optional forming of the catalyst (when this step is carried out on a mixture already containing the nickel), the catalyst is activated in a first step. Activation can correspond either to oxidation then reduction, or to direct reduction, or to calcining alone. The calcining step is generally carried out at temperatures of about 100° C. to about 600° C., preferably in the range 200° C. to 450° C., in a stream of air. The reduction step is carried out under conditions which can convert at least a portion of the oxidised forms of nickel to the metal. In general, it consists of treating the catalyst in a stream of hydrogen at a temperature of at least 300° C. part of the reduction can also be carried out using chemical reducing agents.

The catalyst is preferably at least partially in its sulphurised form. This has the advantage of limiting the risks of hydrogenation of unsaturated compounds such as olefins or aromatic compounds during the start-up stage to a maximum. The sulphur can be introduced between different activation steps. Preferably, no oxidation step is carried out when sulphur or a sulphur-containing compound is introduced into the catalyst. The sulphur or a sulphur-containing compound can be introduced ex situ, i.e., outside the reactor where the process of the invention is carried out, or in situ, i.e., in the reactor used for the process of the invention. In the latter case, the catalyst is preferably reduced under the conditions described above, then sulphurised by passing a feed containing at least one sulphur-containing compound, which once decomposed leads to fixing of sulphur on the catalyst. This feed can be gaseous or liquid, for example hydrogen containing $H_2S$, or a liquid containing at least one sulphur-containing compound.

Preferably, the sulphur-containing compound is added to the catalyst ex situ. As an example, after the calcining step, a sulphur-containing compound can be introduced onto the catalyst in the optional presence of another compound. The catalyst is then dried and transferred into the reactor serving to carry out the process of the invention. In this reactor, the catalyst is then treated in hydrogen to transform at least part of the nickel into the sulphide. A procedure which is particularly suitable for the invention is that described in French patents FR-B-2 708 596 and FR-B-2 708 597.

After sulphurisation, the sulphur content of the catalyst is generally in the range 0.5% to 25% by weight, preferably in the range 4% to 20% by weight.

Using the catalyst described above, hydrodesulphurisation of the light fraction of the gasoline is aimed at converting the sulphur-containing compounds of the cut into $H_2S$, so as to obtain an effluent which after mixing with the desulphurised heavy gasoline will satisfy the desired specifications as regards the sulphur-containing compound content. The light cut produced has the same distillation interval and a slightly lower octane number, because of partial but inevitable saturation of the olefins.

The operating conditions for the hydrotreatment reactor of the present invention must be adjusted so as to reach the desired degree of hydrodesulphurisation, and to minimise the octane number loss resulting from olefin saturation. The catalyst used in the process of the invention can generally convert at most 70% of the olefins, preferably at most 60–65% of the olefins, and more preferably at most 20% of the olefins (the olefins being completely or practically completely hydrogenated). With the catalyst of the process of the invention, high degrees of hydrodesulphurisation can thus be achieved while limiting the olefin loss and consequently the fall in octane number.

The light fraction is hydrodesulphurised in the presence of hydrogen with a nickel-based catalyst, at a temperature in the range from about 160° C. to about 420° C., at a low to moderate pressure, generally in the range from about 0.5 to about 8 MPa. The liquid space velocity is in the range about 0.5 to about $10h^{-1}$ (expressed as the volume of liquid per volume of catalyst per hour), preferably in the range 1 to $8h^{-1}$. The $H_2$/HC ratio is adjusted as a function of the desired degree of hydrodesulphurisation within a range from about 100 to about 600 litres per litre.

Preferably, the temperature is in the range 200° C. to 400° C., more preferably in the range 290° C. to 350° C. the pressure is preferably in the range 1 to 3 MPa.

Hydrodesulphurisation of the Heavy Fraction

The fraction corresponding to the heavy fraction undergoes conventional hydrotreatment (hydrodesulphurisation) carried out on a conventional hydrotreatment catalyst to convert the sulphur-containing compounds of the cut to $H_2S$, and, after mixing with the desulphurised light gasoline, obtain an effluent which satisfies the desired specifications as regards the sulphur-containing compound content.

The desulphurised heavy fraction has the same distillation interval and the octane number is slightly lower than before hydrotreatment, because of total saturation of the olefins.

The octane number fall is limited as the olefin content of the heavy fraction (heavy gasoline) is generally less than 20% by weight and preferably less than 10% by weight.

The operating conditions for the hydrotreatment reactor of the present invention must be adjusted to attain the desired degree of desulphurisation. In general, at least 90% of the sulphur-containing compounds present in the heavy gasoline are converted to $H_2S$.

The heavy fraction undergoes hydrotreatment in the presence of hydrogen with a catalyst containing at least one group VIII metal and/or at least one group VIB metal, at a temperature in the range from about 160° C. to about 420° C., at a pressure which is generally in the range from about 0.5 to about 8 MPa. The liquid space velocity is in the range from about 0.5 to about $10h^{-1}$ (expressed as the volume of liquid per volume of catalyst per hour), preferably in the range 1 to $6h^{-1}$. The $H_2$/HC ratio is adjusted as a function of the desired degree of desulphurisation within the range 100 to 600 litres per litre, preferably in the range 300 to 600 litres per litre.

The temperature is preferably in the range 200° C. to 300° C. The pressure is preferably in the range 2 to 4 MPa.

In order to carry out the heavy gasoline hydrotreatment reaction of the process of the invention, in general at least one conventional hydrodesulphurisation catalyst is used, comprising at least one group VIII metal (metals from groups 8, 9 and 10 of the new classification, i.e., iron., ruthenium, osmium, cobalt, rhodium, iridium, nickel, palladium or platinum) and/or at least one metal from group VIB (metals from group 6 of the new classification, i.e., chromium, molybdenum or tungsten), on a suitable support. The group VIII metal, when present, is generally nickel or cobalt, and the group VIB metal, when present, is generally molybdenum or tungsten. Combinations such as nickel-molybdenum or cobalt-molybdenum are preferred. The catalyst support is normally a porous solid such as an alumina, a silica-alumina, or other porous solids such as magnesia, silica or titanium oxide, used alone or mixed with alumina or silica-alumina.

Implementation of the Process of the Invention

The process of the invention as described above can, for example, be carried out in a configuration which comprises firstly separating, for example by distillation, the gasoline into two fractions:

a light fraction, with initial and end points of 20° C. and 160° C. respectively, and which comprise the major portion of the olefins and a portion of the sulphur-containing compounds;

a heavy fraction, with an initial point of more than 160° C., for example, and which comprises the heaviest sulphur-containing compounds and, as unsaturated compounds, few olefins but mainly aromatic compounds.

Each of the two fractions then undergoes hydrodesulphurisation under the conditions described above, to almost completely eliminate the sulphur from the heavy fraction and to eliminate a portion of the sulphur present in the light fraction, preferably with a limit of attaining the sulphur content necessary so that the product obtained by mixing the two hydrodesulphurised cuts has a sulphur content corresponding to the desired specifications.

A further possibility consists of placing the reaction zones where hydrodesulphurisation of the light and heavy fractions of the gasoline are carried out outside the distillation zone but using as a feed for the hydrodesulphurisation reaction zones liquid fractions withdrawn from plates in the distillation zone, with a recycle of the desulphurised effluents to said distillation zone, to one or more levels located above or below, preferably close to, the withdrawal levels.

It is also possible to use a further configuration in which the hydrotreatment catalysts for treating the light and heavy fractions of the gasoline are placed directly in the distillation zone to separate the light fraction from the heavy fraction.

The following examples illustrate the invention without limiting its scope.

Table 1 shows the characteristics of the feed (catalytically cracked gasoline) treated by the process of the invention. The analysis methods used to characterize the feeds and effluents were as follows:

gas phase chromatography (GPC) for the hydrocarbon-containing constituents;

method NF M 07022/ASTM D 3227 for the mercaptans;

method NF M 07052 for total sulphur;

method NF EN 25164/M 07026-2/ISO 5164/ASTM D 2699 for the research octane number;

method NF EN 25163/M 07026-1/ISO 5163/ASTM D 2700 for the motor octane number.

TABLE 1 characteristics of feed used

| | Feed |
|---|---|
| Density | 0.75 |
| Initial point (° C.) | 80° C. |
| End point (° C.) | 240° C. |
| Olefins content (vol %) | 25 |
| S total (ppm) | 4500 |
| S ex mercaptans (ppm) | 0 |
| RON | 95 |
| MON | 82 |
| (RON + MON)/2 | 88.5 |

EXAMPLE 1 (comparative)

Hydrodesulphurisation of Non Fractionated Gasoline 25 ml of HR306®, sold by Procatalyse, was placed in the hydrodesulphurisation reactors. The catalyst was first sulphurised by treatment for 4 hours at a pressure of 3.4 MPa at 350° C., in contact with a feed constituted by 2% of sulphur in the form of dimethyldisulphide in n-heptane.

The hydrodesulphurisation operating conditions were as follows: T–270° C., HSV=$4h^{-1}$, $H_2$/HC=125 1/1, P=2.7 MPa. Under these conditions, the effluent after desulphurisation had the characteristics described in Table 2.

TABLE 2

Comparison of characteristics of the feed and desulphurised effluent

| | Feed | Effluent |
|---|---|---|
| S total (ppm) | 4500 | 315 |
| S ex mercaptans (ppm) | 0 | 150 |
| Olefins (vol %) | 25 | 8 |
| MON | 82 | 76 |
| RON | 95 | 85 |
| (RON + MON)/2 | 88.5 | 80.5 |
| Octane number loss | — | 8 |
| % HDS* | | 93.1 |
| % HDO** | | 68 |

*% HDS designates the degree of hydrodesulphurisation

**% HDO designates the degree of olefin hydrogenation

EXAMPLE 2 (in accordance with the invention)

Hydrodesulphurisation of Fractionated Gasoline

The gasoline with the characteristics shown in Table 1 was fractionated into two cuts, one with an end point of 110°

C. (light cut) and the other with an initial point of 110° C. (heavy cut). The characteristics of the distilled gasoline and the yield from each cut is described in Table 3.

TABLE 3

Characteristics of distilled gasoline and yield from each cut

| | Feed | Light gasoline | Heavy gasoline |
|---|---|---|---|
| Volume (%) | | 45 | 55 |
| S total (ppm) | 4500 | 1600 | 6900 |
| S ex mercaptans (ppm) | 0 | 0 | 0 |
| Olefins (vol %) | 25 | 46 | 7.5 |
| Initial point (° C.) | 80 | 80 | 110 |
| End point (° C.) | 240 | 110 | 240 |

The heavy gasoline fraction underwent hydrodesulphurisation on a conventional hydrotreatment catalyst in an isothermal tube reactor. 25 ml of HR306C® catalyst sold by Procatalyse was placed in a hydrodesulphurisation reactor. The catalyst was first sulphurised by treatment for 4 hours at a pressure of 3.4 MPa at 350° C., in contact with a feed constituted by 2% of sulphur in the form of dimethyldisulphide in n-heptane.

The hydrodesulphurisation operating conditions were as follows: T280° C., HSV=4 $h^{-1}$, $H_2$/HC=125 1/1, P=2.7 MPa. Under these conditions, the sulphur content of the effluent after 15 desulphurisation was less than 1 ppm and the olefin content was less than 1% by volume.

The light gasoline fraction underwent hydrotreatment on a nickel-based catalyst, in an isothermal tube reactor. The catalyst was prepared as follows.

It was prepared from a 140 $m^2$/g transition alumina in the form of 2 mm diameter beads. The pore volume was 1 ml/g of support. 1 kilogram of support was impregnated with 1 litre of nickel nitrate solution. The catalyst was then dried at 120° C. and calcined in a stream of air at 400° C. for one hour. The nickel content of the catalyst was 20% by weight. The catalyst (100 ml) was then sulphurised by treatment for 4 hours at a pressure of 3.4 MPa at 350° C., in contact with a feed containing 4% of sulphur in the form of dimethyldisulphide in n-heptane.

The light gasoline was then hydrodesulphurised. The temperature was 280° C.; the feed flow rate was 200 ml/hour. The $H_2$/feed ratio, expressed in litres of hydrogen per litre of feed, was 400, the operating pressure was 2.7 MPa.

Under these conditions, an analysis of the liquid effluent gave the results presented in Table 5.

ABLE 5

Hydrodesulphurisation of light gasoline on nickel catalyst

| | Light gasoline | Desulphurised light gasoline |
|---|---|---|
| S total (ppm) | 1600 | 700 |
| S ex mercaptans (ppm) | 0 | 20 |
| Olefins (vol %) | 46 | 43 |
| Initial point (° C.) | 80 | 80 |
| End point (° C.) | 110 | 110 |

The separately desulphurised light gasoline and heavy gasoline were then mixed. The product obtained had the following characteristics:

TABLE 6

Characteristics of the light gasoline - heavy gasoline after hydrodesulphurisation step

| | Feed | Effluent |
|---|---|---|
| S total (ppm) | 4500 | 315 |
| S ex mercaptans (ppm) | 0 | 9 |
| Olefins (vol %) | 25 | 19.5 |
| MON | 82 | 81.2 |
| RON | 95 | 92 |
| (RON + MON)/2 | 88.5 | 86.6 |
| Octane number loss | — | 1.9 |
| % HDS* | | 93.1 |
| % HDO** | | 22 |

*% HDS designates the degree of hydrodesulphurisation
**% HDO designates the degree of olefin hydrogenation

EXAMPLE 3 (comparative)

Hydrodesulphurisation of Gasoline Fractionated Using a Cobalt-molybdenum catalyst The gasoline with the characteristics shown in Table 1 was fractionated into two cuts, one with an end point of 110° C. (light cut) and the other with an initial point of 110° C. (heavy cut). The characteristics of the distilled gasoline and the yield from each cut are described in Table 3 of Example 2.

The heavy gasoline fraction underwent hydrodesulphurisation on a conventional hydrotreatment catalyst in an isothermal tube reactor. 25 ml of HR306C® catalyst sold by Procatalyse was placed in a hydrodesulphurisation reactor. The catalyst was first sulphurised by treatment for 4 hours at a pressure of 3.4 MPa at 350° C., in contact with a feed constituted by 2% of sulphur in the form of dimethyldisulphide in n-heptane.

The hydrodesulphurisation operating conditions were as follows: T=280° C., HSV=4$h^{-1}$, $H_2$/ HC=125 1/1, P=2.7 MPa. Under these conditions, the sulphur content of the effluent after desulphurisation was less than 1 ppm and the olefin content was less than 1% by volume.

The light gasoline fraction underwent hydrodesulphurisation on a HR306C® catalyst in an isothermal tube reactor. The catalyst was first sulphurised by treatment for 4 hours at a pressure of 3.4 MPa at 350° C., in contact with a feed constituted by 2% of sulphur in the form of dimethyldisulphide in n-heptane.

The light gasoline was then hydrodesulphurised under the following conditions: T=220° C., HSV=4 $h^{-1}$, $H_2$/HC=400 1/1, P=2.7 MPa.

Under these conditions, an analysis of the liquid effluent produced the results shown in Table 7.

TABLE 7

Hydrodesulphurisation of light gasoline on HR306C ® catalyst

| | Light gasoline | Desulphurised light gasoline |
|---|---|---|
| S total (ppm) | 1600 | 700 |
| S ex mercaptans (ppm) | 0 | 250 |
| Olefins (vol %) | 46 | 36 |
| Initial point (° C.) | 80 | 80 |
| End point (° C.) | 110 | 110 |

The separately desulphurised light gasoline and heavy gasoline were then mixed. The product obtained had the following characteristics:

TABLE 8

Characteristics of the light gasoline - heavy gasoline mixture after hydrodesulphurisation step

| | Feed | Effluent |
|---|---|---|
| S total (ppm) | 4500 | 315 |
| S ex mercaptans (ppm) | 0 | 113 |
| Olefins (vol %) | 25 | 16 |
| MON | 82 | 78.6 |
| RON | 95 | 88.6 |
| (RON + MON)/2 | 88.5 | 83.6 |
| Octane number loss | — | 4.9 |
| % HDS* | | 93.1 |
| % HDO** | | 36 |

*% HDS designates the degree of hydrodesulphurisation
**% HDO designates the degree of olefin hydrogenation The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding French application 98/14.480, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for producing a gasoline with a low sulphur content, in which said process comprises the stages of:

separating a gasoline containing sulphur into a light fraction and a heavy fraction, the cut point being selected so that the light fraction has a higher olefin content than the heavy fraction;

hydrodesulphurising the light fraction on a nickel-based catalyst under conditions limiting olefin conversion, wherein the nickel-based catalyst consists essentially of nickel as the catalytically active metal;

hydrodesulphurising the heavy fraction on a catalyst comprising at least one group VIII metal selected from the group consisting of iron, ruthenium, osmium, cobalt, rhodium, iridium, palladium, platinum, and/or at least one group VIB metal, and;

mixing the resultant desulphurised light and heavy fractions.

2. A process according to claim 1, in which the sulphur-containing gasoline originates from a catalytic cracking process.

3. A process according to claim 1, in which the catalyst for hydrodesulphurising the heavy fraction comprises a group VIB metal and at least one of the group VIII metal.

4. A process according to claim 3, in which the group VIB metal is molybdenum or tungsten and the group VIII metal is cobalt.

5. A process according to claim 1, wherein the gasoline containing sulphur contains dienes, and prior to separation of the sulphur-containing gasoline into light and heavy fraction, the dienes present in the sulphur-containing gasoline are hydrogenated.

6. A process according to claim 1, in which the cut point between the light fraction and the heavy fraction is at a temperature of less than 160° C.

7. A process according to claim 1, in which the heavy fraction contains less than 20% by weight of the total olefins in the gasoline.

8. A process according to claim 1, in which the light fraction and the heavy fraction are hydrodesulphurised in the presence of hydrogen, at a temperature in the range 160° C. to 420° C., at a pressure in the range from about 0.5 to about 8 MPa, at a liquid space velocity in the range from about 0.5 to about 10 $h^{-1}$ and an $H_2$/HC ratio between about 100 to about 600 litres per litre.

9. A process according to claim 1, in which separation is carried out in a distillation column and in which feeds for the hydrodesulphurisation stages are withdrawn from different levels in said column and effluents from said hydrodesulfurization stages are returned to said column.

10. A process according to claim 1, in which separation stage is carried out in a distillation column and in which the hydrodesulphurisation catalysts are placed inside said column.

11. A process according to claim 6, in which the catalyst for hydrodesulphurising the heavy fraction comprises a group VIB metal and at least one of the group VIII metals.

12. A process according to claim 11, in which the group VIB metal is molybdenum or tungsten and the group VIII metal is cobalt.

13. A process according to claim 12, in which the heavy fraction contains less than 20% by weight of the total olefins in the gasoline.

14. A process according to claim 8, in which the cut point between the light fraction and the heavy fraction is at a temperature of less than 160° C.

15. A process according to claim 8, in which the heavy fraction contains less than 20% by weight of the total olefins in the gasoline.

16. A process according to claim 14, in which the heavy fraction contains less than 20% by weight of the total olefins in the gasoline.

17. A process according to claim 1, wherein the initial boiling point of the heavy fraction is more than 140° C.

18. A process according to claim 1, wherein the initial boiling point of the heavy fraction is more than 120° C.

19. A process according to claim 1, wherein the hydrodesulfurizing of the light fraction is conducted under conditions limiting olefin conversion to saturated compounds to less than 20% of the olefins.

20. A process according to claim 1, wherein said light fraction has an initial boiling point of 20° C. and an end boiling point of 160° C.

21. A process for producing a gasoline with a low sulphur content, in which said process comprises the stages of:

separating a gasoline containing sulphur into a light fraction and a heavy fraction, the cut point being selected so that the light fraction has a higher olefin content than the heavy fraction;

hydrodesulphurising the light fraction on a catalyst of a metal consisting essentially of nickel as the catalytically active metal under conditions limiting olefin conversion;

hydrodesulphurising the heavy fraction on a catalyst comprising at least one group VIII metal and/or at least one group VIB metal, provided that, when catalyst contains nickel as the group VIII metal, the catalyst also contains an essential amount of at least one group VIB metal, and;

mixing the resultant desulphurised light and heavy fractions.

22. A process according to claim 21, wherein the catalyst for hydrodesulphurising the heavy fraction comprises both at least one group VIII metal and at least one VIB metal.

23. A process according to claim 23, in which the group VIB metal is molybdenum or tungsten and the group VIII metal is nickel or cobalt.

* * * * *